US009337005B2

(12) United States Patent
Brown et al.

(10) Patent No.: US 9,337,005 B2
(45) Date of Patent: May 10, 2016

(54) METHOD OF MS/MS MASS SPECTROMETRY

(71) Applicant: Micromass UK Limited, Wilmslow (GB)

(72) Inventors: Jeffery Mark Brown, Hyde (GB); Martin Raymond Green, Bowdon (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/401,415

(22) PCT Filed: May 16, 2013

(86) PCT No.: PCT/GB2013/051259
§ 371 (c)(1),
(2) Date: Nov. 14, 2014

(87) PCT Pub. No.: WO2013/171493
PCT Pub. Date: Nov. 21, 2013

(65) Prior Publication Data

US 2015/0144780 A1 May 28, 2015

Related U.S. Application Data

(60) Provisional application No. 61/651,237, filed on May 24, 2012, provisional application No. 61/715,503, filed on Oct. 18, 2012.

(51) Int. Cl.
*H01J 49/00* (2006.01)
*H01J 49/04* (2006.01)

(52) U.S. Cl.
CPC ..... *H01J 49/0054* (2013.01); *H01J 49/0031* (2013.01); *H01J 49/0072* (2013.01)

(58) Field of Classification Search
CPC ..... G01N 30/72; G01N 30/8665; G01N 30/8644; G01N 30/8668; G01N 30/8679
USPC ..... 250/282, 281, 288, 292, 423 R, 424, 250/396 R; 702/27, 30
See application file for complete search history.

(56) References Cited

U.S. PATENT DOCUMENTS 6,717,130 B2 4/2004 Bateman et al.
7,026,613 B2 * 4/2006 Syka ..... H01J 49/0095 250/282

(Continued)

FOREIGN PATENT DOCUMENTS

WO 2011/058381 5/2011

OTHER PUBLICATIONS

Robb et al., "*Liquid Chromatography-Atmospheric Pressure Electron Capture Dissociation Mass Spectrometry for the Structural Analysis of Peptides and Proteins*", Analytical Chemistry, vol. 84, No. 9, pp. 4221-4226, 2012.

*Primary Examiner* — David A Vanore
(74) *Attorney, Agent, or Firm* — Diederiks & Whitelaw, PLC

(57) ABSTRACT

A method of mass spectrometry is disclosed comprising alternating between a first mode in which parent ions are mass analyzed and a second mode in which the parent ions are subjected to Electron Capture Dissociation ("ECD") at atmospheric pressure so as to produce fragment ions which are then mass analyzed. The parent ions are associated with their fragment ions based on the times at which they were detected. This method enables parent ions to be associated with their fragment ions, even when the ECD fragmentation is performed at atmospheric pressure.

26 Claims, 1 Drawing Sheet

(56) References Cited

U.S. PATENT DOCUMENTS

| | | | | |
|---|---|---|---|---|
| 7,555,393 | B2 * | 6/2009 | Sadygov | G01N 33/6848 702/19 |
| 7,582,862 | B2 * | 9/2009 | Hartmer | H01J 49/145 250/281 |
| 7,642,509 | B2 * | 1/2010 | Hartmer | H01J 49/0045 250/281 |
| 7,858,929 | B2 * | 12/2010 | Makarov | H01J 49/06 250/281 |
| 7,872,228 | B1 * | 1/2011 | Kim | H01J 49/423 250/287 |
| 7,928,363 | B2 | 4/2011 | Bateman | |
| 8,080,783 | B2 * | 12/2011 | Whitehouse | H01J 49/0431 250/282 |
| 8,105,838 | B2 * | 1/2012 | Gorenstein | G01N 30/72 436/86 |
| 8,165,820 | B2 * | 4/2012 | Gorenstein | G01N 30/72 250/282 |
| 8,188,423 | B2 * | 5/2012 | Doroshenko | H01J 49/0045 250/281 |
| 8,237,106 | B2 | 8/2012 | Castro-Perez et al. | |
| 8,362,424 | B2 * | 1/2013 | Brown | H01J 49/065 250/281 |
| 8,592,752 | B2 | 11/2013 | Gorenstein et al. | |
| 8,598,514 | B2 | 12/2013 | Robb | |
| 8,624,179 | B2 * | 1/2014 | Chen | H01J 49/0072 250/281 |
| 8,710,430 | B2 * | 4/2014 | Sugiyama | H01J 49/0009 250/283 |
| 8,822,914 | B2 * | 9/2014 | Goshawk | H01J 49/0027 250/281 |
| 9,111,735 | B1 * | 8/2015 | Nikolaev | H01J 49/0036 |
| 2008/0173807 | A1 | 7/2008 | Yoon et al. | |
| 2009/0302210 | A1 * | 12/2009 | Castro-Perez | H01J 49/0031 250/282 |
| 2009/0321628 | A1 * | 12/2009 | Bateman | H01J 49/0036 250/282 |
| 2011/0062323 | A1 * | 3/2011 | Brown | H01J 49/0072 250/282 |
| 2015/0034813 | A1 | 2/2015 | Brown et al. | |
| 2015/0090875 | A1 * | 4/2015 | Brown | H01J 49/0031 250/282 |
| 2015/0287584 | A1 * | 10/2015 | Green | H01J 49/0031 250/287 |

* cited by examiner

METHOD OF MS/MS MASS SPECTROMETRY

CROSS-REFERENCE TO RELATED APPLICATIONS

This application is the National Stage of International Application No. PCT/GB2013/051259 filed on 16 May 2013, which claims priority from and the benefit of: United Kingdom patent application No. 1208735.5 filed on 18 May 2012, United Kingdom patent application No. 1218516.1 filed on 16 Oct. 2012, U.S. patent application No. 61/651,237 filed on 24 May 2012, and U.S. patent application No. 61/715,503 filed on 18 Oct. 2012. The entire contents of these applications are incorporated herein by reference.

BACKGROUND OF THE PRESENT INVENTION

The present invention relates to a mass spectrometer and a method of mass spectrometry that use Electron Capture Dissociation ("ECD") or Electron Transfer Dissociation ("ETD") to fragment ions.

Atmospheric pressure Electron Capture Dissociation ("AP-ECD") mass spectrometers are known wherein analyte ions generated by an Electrospray ("ESI") ion source interact with photoelectrons. A UV lamp is arranged to emit UV photons which are absorbed by gas, causing the release of photoelectrons. Analyte ions interact with the photoelectrons causing the analyte ions to fragment at atmospheric pressure.

A problem with known AP-ECD mass spectrometers is that it is difficult to associate parent ions with their fragment ions. Alternative techniques tend to associate parent ions with their fragment ions by selecting a single type of parent ion at a given time and fragmenting this single parent ion to determine its fragment ions. Although this technique has a relatively low duty cycle, since other parent ions are discarded whilst the single parent ion is selected, it provides a relatively simple method of associating parent ions with their fragment ions. However, in AP-ECD techniques there is no means of selecting a specific parent ion for fragmentation because the parent ions are arranged in a high pressure region and so the conventional techniques for ion selection cannot be used. Furthermore, once the analyte ions have been fragmented there is no known means of associating the fragment ions to their precursor ions. When a sample being analysed contains a mixture of analytes, this can result in complex fragment ion spectra which include photo-ionised solvent background peaks, dopant ions and their derivatives, un-reacted parent ions, as well as mixtures of fragment ions and charge-reduced species from different parent ions. Accordingly, assigning parent ions to their fragment ions remains a complex problem in AP-ECD techniques and this complexity limits the analytical utility and commercial acceptance of the technique.

It is desired to provide an improved mass spectrometer and method of mass spectrometry. Preferably, it is desired to provide a mass spectrometer and method of mass spectrometry that are able to fragment parent ions via ECD or ETD at atmospheric pressure and then associate the resulting fragment ions with their parent ions.

SUMMARY OF THE PRESENT INVENTION

From a first aspect the present invention provides a method of mass spectrometry comprising:

(i) providing a plurality of different parent ions;

(ii) mass analysing said parent ions so as to obtain first mass spectral data;

(iii) subjecting said parent ions to Electron Capture Dissociation ("ECD") and/or Electron Transfer Dissociation ("ETD") at atmospheric pressure to produce fragment and/or product ions;

(iv) mass analysing said fragment and/or product ions so as to obtain second mass spectral data;

(v) wherein the parent ions are intermittently and repeatedly subjected to said ECD and/or ETD such that the method repeatedly alternates between steps (ii) and (iv); and (vi) associating parent ions detected in said first mass spectral data with fragment and/or product ions detected in said second mass spectral data.

Conventionally, it has been very difficult to associate fragment ions with their parent ions when the fragment ions have been generated by ECD or ETD at atmospheric pressures. As described in the Background to the Present Invention section above, conventional techniques have considered it necessary to use equipment operating under vacuum conditions, such as a tandem mass spectrometer, in order associate parent ions with their fragment ions. The present invention recognises that the above-described technique of alternating between a parent ion analysis mode and an ECD and/or ETD fragment ion analysis mode can be used to associate parent ions with their fragment ions after the fragmentation has occurred at atmospheric pressure. This has previously been unrecognised in the art and provides improved analytical utility of the atmospheric pressure ECD and ETD mass spectral techniques.

According to the present invention, fragment or product ions are preferably associated with a parent ion when that fragment or product ion is mass analysed at substantially the same time as that parent ion is mass analysed. By this it is meant that parent ions in any given set of first mass spectral data are associated with fragment ions in a set of second mass spectral data that is obtained immediately before or immediately after said given set of first mass spectral data is obtained.

The method preferably alternates between steps (ii) and (iv) above at a rate such that each species of parent ion in said plurality of ions is subjected to both said steps (ii) and (iv).

Preferably, the step of providing the plurality of different parent ions comprises providing different parent ions that are spatially separated from each other such that they are received at a mass analyser at different times and are mass analysed at different times in step (ii) of the above-described method. The parent ions are preferably subjected to said ECD and/or ETD after they have been separated and such that fragment and/or product ions that are derived from different parent ions are mass analysed in step (iv) of the above-described method at different times.

The parent ions are preferably generated by subjecting a sample to chromatography and ionising the eluting sample, wherein the chromatography is preferably liquid chromatography. The times at which the different parent ions are mass analysed in step (ii) of the above-described-method is preferably related to the chromatography elution times of said parent ions; and the times at which the fragment and/or product ions are mass analysed is preferably related to the chromatography elution times of their respective parent ions. The step of associating parent ions detected in said first mass spectral data with fragment and/or product ions detected in said second mass spectral data may comprise matching liquid chromatography elution time profiles of ions observed in said first mass spectral data with liquid chromatography elution time profiles of ions observed in said second mass spectral data.

As described above, the step of providing the plurality of different parent ions preferably comprises providing different parent ions that are spatially separated from each other such that they are received at a mass analyser at different times and are mass analysed at different times. The different parent ions may be separated in an ion mobility spectrometer according to their ion mobility such that they are received at a mass analyser at different times and are mass analysed at different times in step (ii) of the above-described method. The times at which the different parent ions are mass analysed is preferably related to the drift times of the parent ions through the ion mobility spectrometer; and the times at which the fragment and/or product ions are mass analysed is preferably related to the drift times of their respective parent ions through the ion mobility spectrometer. Preferably, the step of associating parent ions detected in said first mass spectral data with fragment and/or product ions detected in said second mass spectral data comprises matching ion mobility drift time profiles of ions observed in said first mass spectral data with ion mobility drift time profiles of ions observed in said second mass spectral data.

The ion mobility separator is preferably provided upstream of the region in which said ECD and/or ETD is performed so as to separate the parent ions according to their ion mobility. The ion mobility separator preferably operates substantially at atmospheric pressure.

Additionally, or alternatively, an ion mobility separator may be provided downstream of the region in which said ECD and/or ETD is performed. The ion mobility separator separates the ions produced by the ECD and/or ETD conditions and may operate substantially at atmospheric pressure or under vacuum conditions (e.g. a few mBar).

Preferably, the method of mass spectrometry comprises comparing first and second mass spectral data that have been obtained at substantially the same time (i.e. adjacent data sets); and recognising as parent ions, ions having a greater intensity in the first mass spectral data relative to the second mass spectral data. Additionally, or alternatively, the method may comprise comparing first and second mass spectral data that have been obtained at substantially the same time (i.e. adjacent data sets); and recognising as fragment or product ions, ions having a greater intensity in the second mass spectral data relative to the first mass spectral data.

The step of intermittently and repeatedly subjected the parent ions to said ECD and/or ETD may comprise either: repeatedly and intermittently providing electrons and/or or reagent anions to a dissociation region through which the parent ions pass for inducing said ECD and/or ETD; or performing said ECD and/or ETD in a dissociation region and repeatedly and intermittently causing parent ions to bypass the dissociation region. A photo-ionisation source may be used to generate the electrons and/or reagent ions and the photo-ionisation source may be repeatedly switched ON and OFF. Alternatively, the parent ions may be caused to repeatedly and intermittently by-pass the photo-ionisation source.

The method may comprise subjecting the fragment and/or product ions to a fragmentation technique other than atmospheric pressure ECD and/or ETD between steps (iii) and (iv) mentioned above, and the resulting ions may be mass analysed in step (iv) mentioned above. This additional fragmentation technique fragments intermediate ions that may remain after the atmospheric pressure ECD and/or ETD reaction conditions. Intermediate ions are non-dissociated parent ions held together by non-covalent interactions and/or are charge-reduced parent ions that have not fragmented after being exposed to the ECD and/or ETD conditions The method preferably comprises performing a cycle comprising:

(i) mass analysing the parent ions so as to obtain said first mass spectral;

(ii) subjecting the parent ions to ECD and/or ETD at atmospheric pressure to produce fragment and/or product ions; and mass analysing the fragment and/or product ions; and (iii) subjecting the parent ions to ECD and/or ETD at atmospheric pressure, thereby producing intermediate ions, wherein the intermediate ions are non-dissociated parent ions held together by non-covalent interactions and/or are charge-reduced parent ions that have not fragmented after being exposed to the ECD and/or ETD conditions; and subjecting the intermediate ions to a fragmentation technique other than atmospheric pressure ECD and/or ETD such that the intermediate ions fragment to form fragment ions; and mass analysing these fragment ions so as to obtain third mass spectral data.

Preferably, parent ions are substantially only fragmented by ECD and/or ETD reactions in step (ii) above.

The method preferably comprises associating the fragment ions produced by step (iii) above with parent ions by correlating the times at which these fragment ions are mass analysed to the times at which the parent ions are mass analysed.

The method preferably repeatedly and continuously performs said cycle.

A fragment ion produced by said step (iii) above may be associated with a parent ion that is mass analysed in the same cycle or in an immediately preceding or immediately subsequent cycle.

The method preferably alternates between the three modes in each cycle at a rate such that each species of parent ion in the plurality of ions is subjected to all three modes.

The method may comprise comparing the third mass spectral data to the first mass spectral data obtained at substantially the same time (i.e. obtained in the same cycle or in an immediately preceding or immediately subsequent cycle), and recognising as fragment ions, ions having a greater intensity in the third mass spectral data relative to the first mass spectral data. Alternatively, or additionally, the method may comprise comparing the third mass spectral data to second mass spectral data obtained at substantially the same time (i.e. obtained in the same cycle or in an immediately preceding or immediately subsequent cycle), and recognising ions having a greater intensity in the third mass spectral data relative to the second mass spectral data as being fragment ions derived from said fragmentation technique other than ECD and/or ETD.

Said fragmentation technique other than atmospheric pressure ECD and/or ETD is preferably Collisionally Induced Dissociation ("CID") fragmentation. The ions may be intermittently and repeatedly fragmented by passing the intermediate ions through a CID fragmentation device that is repeatedly switched between a high collision mode and a low collision mode; or by ions being intermittently and repeatedly caused to by-pass the CID fragmentation device. It is contemplated that the fragmentation technique other than atmospheric pressure ECD and/or ETD may be an alternative fragmentation technique to CID. For example, the fragmentation technique other than atmospheric pressure ECD and/or ETD may be the fragmentation of ions by ECD and/or ETD under vacuum conditions.

The fragmentation technique other than atmospheric pressure ECD and/or ETD is preferably performed in a separate device or region to the device or region in which the atmospheric pressure ECD and/or ETD is performed.

An ion mobility separator may be provided between the region in which the atmospheric pressure ECD and/or ETD is performed and the region in which the fragmentation technique other than atmospheric pressure ECD and/or ETD is performed. The ion mobility separator separates the ions produced by the atmospheric pressure ECD and/or ETD conditions before they enter the region in which the fragmentation technique other than atmospheric pressure ECD and/or ETD is performed. The ion mobility separator may operate substantially at atmospheric pressure or under vacuum conditions (e.g. a few mBar).

The step of subjecting said parent ions to ECD and/or ETD may comprise causing electrons and/or reagent anions to interact with parent ions within an RF ion guide or ion trap.

From a second aspect, the present invention also provides a method of mass spectrometry comprising:

providing a plurality of different parent ions; and performing at least one cycle comprising:

(i) mass analysing said parent ions so as to obtain first mass spectral;

(ii) subjecting said parent ions to ECD and/or ETD to produce fragment and/or product ions; and mass analysing said fragment and/or product ions so as to obtain second mass spectral;

(iii) subjecting said parent ions to ECD and/or ETD, thereby producing intermediate ions, wherein the intermediate ions are non-dissociated parent ions held together by non-covalent interactions and/or are charge-reduced parent ions that have not fragmented after being exposed to the ECD and/or ETD conditions; and subjecting said intermediate ions to a fragmentation technique other than ETD and/or ECD such that said intermediate ions fragment to form fragment ions; and mass analysing these fragment ions so as to obtain third mass spectral; and (v) associating parent ions detected in said first mass spectral data with fragment and/or product ions detected in said second and/or third mass spectral data.

The ECD and/or ETD reactions according to this method are preferably performed substantially at atmospheric pressure, although it is contemplated that the reactions could less preferably be performed at sub-atmospheric pressure.

In step (ii), the parent ions are preferably substantially only fragmented by ECD and/or ETD reactions.

The method preferably continuously and repeatedly performs said cycle.

A fragment ions produced by step (iii) is preferably associated with a parent ion when that fragment ion is mass analysed in the same cycle or in an immediately preceding or immediately subsequent cycle to the parent ion.

Said fragmentation technique other than ECD and/or ETD is preferably Collisionally Induced Dissociation ("CID") fragmentation.

The method may alternate between steps (ii) and (iii) by passing the ions through a CID fragmentation device that is repeatedly switched between a low collision mode to perform step (ii) and a high collision mode to perform step (iii). Alternatively, the CID fragmentation device may be continuously operated in a collision mode that fragments ions and the ions may be intermittently and repeatedly caused to by-pass the CID fragmentation device to perform step (ii) and pass through the CID fragmentation device to perform step (iii).

The step of subjecting parent ions to ECD and/or ETD preferably comprises causing said electrons and/or reagent anions to interact with parent ions within an RF ion guide or ion trap.

The present invention also provides a method of identifying an analyte, preferably a biomolecule, comprising ionising the analyte to form parent ions and further comprising any one of the methods described above.

The present invention provides a mass spectrometer arranged and configured to perform any one of the methods described herein above.

For example, the present invention provides a mass spectrometer comprising:

an atmospheric pressure ECD and/or ETD device;

a mass analyser; and a control system arranged and adapted to:

mass analyse parent ions so as to obtain first mass spectral data, in a first mode of operation;

subject said parent ions to ECD and/or ETD at atmospheric pressure to produce fragment and/or product ions;

mass analyse said fragment and/or product ions so as to obtain second mass spectral, in a second mode of operation;

intermittently and repeatedly subject said parent ions to said ECD and/or ETD so as to alternate between the first and second modes of operation; and associate parent ions detected in said first mass spectral data with fragment and/or product ions detected in said second mass spectral.

The present invention also provides a mass spectrometer comprising:

an ECD and/or ETD device;

a mass analyser; and a control system arranged and adapted to perform at least one cycle comprising:

(i) mass analysing parent ions so as to obtain first mass spectral;

(ii) subjecting parent ions to ECD and/or ETD to produce fragment and/or product ions; and mass analysing said fragment and/or product ions so as to obtain second mass spectral data;

(iii) subjecting parent ions to ECD and/or ETD, thereby producing intermediate ions, wherein the intermediate ions are non-dissociated parent ions held together by non-covalent interactions and/or are charge-reduced parent ions that have not fragmented after being exposed to the ECD and/or ETD conditions; and subjecting said intermediate ions to a fragmentation technique other than ETD and/or ECD such that said intermediate ions fragment to form fragment ions; and mass analysing these fragment ions so as to obtain third mass spectral data; and (v) associating parent ions detected in said first mass spectral data with fragment and/or product ions detected in said second and/or third mass spectral.

The present invention also provides a method of mass spectrometry comprising:

generating a plurality of species of parent ions;

varying the intensity profile of one or more species of parent ions as a function of time so that different species of parent ions are caused to have different intensity profiles as a function of time;

subjecting said parent ions to Electron Capture Dissociation ("ECD") and/or Electron Transfer Dissociation ("ETD") at atmospheric pressure to produce fragment and/or product ions;

mass analysing the fragment ions; and correlating the fragment ions with corresponding parent ions on the basis of the intensity profiles of said fragment ions and the intensity profiles of said parent ions.

The method preferably comprises mass analysing the parent ions in order to obtain said profile of one or more species of parent ions.

The method preferably repeatedly alternates between mass analysing parent ions, and fragmenting parent ions and mass analysing the fragment ions. The method may comprise any of the optional or preferred features described above in relation to the first aspect of the present invention.

For example, the parent ions in any given set of mass spectral data may be associated with fragment ions in a set of second mass spectral data that is obtained immediately before or immediately after said given set of first mass spectral data is obtained.

The method preferably alternates between mass analysing parent ions, and fragmenting parent ions and mass analysing the fragment ions at a rate such that each species of parent ion in the plurality of ions is subjected to both steps.

The parent ions may be intermittently and repeatedly subjected to said ECD and/or ETD by either: repeatedly and intermittently providing electrons and/or or reagent anions to a dissociation region through which the parent ions pass for inducing said ECD and/or ETD; or performing said ECD and/or ETD in a dissociation region and repeatedly and intermittently causing parent ions to bypass the dissociation region. A photo-ionisation source may be used to generate said electrons and/or reagent ions and the photo-ionisation source may be repeatedly switch ON and OFF. Alternatively, the parent ions may be caused to intermittently and repeatedly by-pass the photo-ionisation source.

The method may comprise performing a cycle comprising:

(i) mass analysing said parent ions;

(ii) subjecting said parent ions to ECD and/or ETD at atmospheric pressure to produce fragment and/or product ions (wherein the parent ions are preferably substantially only fragmented by ECD and/or ETD reactions); and mass analysing said fragment and/or product ions; and (iii) subjecting said parent ions to ECD and/or ETD at atmospheric pressure, thereby producing intermediate ions, wherein the intermediate ions are non-dissociated parent ions held together by non-covalent interactions and/or are charge-reduced parent ions that have not fragmented after being exposed to the ECD and/or ETD conditions; and subjecting said intermediate ions to a fragmentation technique other than atmospheric pressure ECD and/or ETD such that said intermediate ions fragment form fragment ions; and mass analysing these fragment ions.

The method preferably repeatedly performs said cycle.

The method may comprise associating the fragment ions with parent ions that are mass analysed in the same cycle.

The method preferably alternates between the three modes in the cycle at a rate such that each species of parent ion in said plurality of ions is subjected to all three modes.

Said fragmentation technique other than atmospheric pressure ECD and/or ETD is preferably Collisionally Induced Dissociation ("CID"). Alternatively, the fragmentation technique other than atmospheric pressure ECD and/or ETD may be the fragmentation of ions by ECD and/or ETD under vacuum conditions.

The step of varying the intensity profile of one or more species of parent ions as a function of time preferably comprises subjecting an analyte sample to chromatography. The ions may then be correlated with fragment ions by matching chromatographic elution time profiles of the parent and fragment ions.

The step of varying the intensity profile of one or more species of parent ions as a function of time may comprise separating the parent ions in an ion mobility spectrometer, wherein the parent ions are correlated with fragment ions by matching ion mobility drift time profiles of the parent and fragment ions.

The present invention also provides a mass spectrometer comprising:

means for generating a plurality of species of parent ions;

means for varying the intensity profile of one or more species of parent ions as a function of time so that different species of parent ions are caused to have different intensity profiles as a function of time;

means for subjecting said parent ions to Electron Capture Dissociation ("ECD") and/or Electron Transfer Dissociation ("ETD") at atmospheric pressure to produce fragment and/or product ions;

means for mass analysing the fragment ions; and means for correlating the fragment ions with corresponding parent ions on the basis of the intensity profiles of said fragment ions and the intensity profiles of said parent ions.

The mass spectrometer may be configured to perform any of the methods described herein above.

The mass spectrometers disclosed herein may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The preferred embodiment addresses the problem of not being able to associate parent ions with fragment ions formed in an AP-ECD source. According to a preferred embodiment, parent ions are generated from a sample eluting from a liquid chromatography column. Reagent ions and/or electrons are then provided to the parent ions so as to subject the parent ions to ETD and/or ECD fragmentation via ion-ion or ion-electron reactions. For example, electrons may be generated by a UV lamp for causing the ECD reactions and the parent ions may be intermittently and repeatedly subjected to ECD conditions by switching the UV lamp ON and OFF. The electrons provide ECD reaction conditions and cause some parent ions to fragment and may also generate intermediate product ions that are essentially undissociated parent ions of reduced charge (i.e. ECnoD ions). The parent ions and the fragment or product ions arrive alternately at the mass analyser and are mass analysed. Data processing is then used to associate the parent ions with their fragment or product ions, preferably based on their simultaneous liquid chromatographic elution time profiles. It may also be desirable to identify or obtain information from the intermediate product ions by causing them to fragment and correlating the fragment ions to their parent ions or intermediate product ions. The intermediate ions may be intermittently fragmented by collisionally induced dissociation ("CID") so that intermediate ions and their fragment ions arrive alternately at the mass analyser. The intermediate product ions and their fragment ions are alternately mass analysed and data processing is then used to associate the CID fragment ions with their intermediate product ions or corresponding parent ions, preferably based on their simultaneous liquid chromatography elution time profiles.

According to the preferred embodiment, ECD is preferably the sole or dominant mechanism by which parent ions are caused to fragment or dissociate. However, other embodiments are also contemplated wherein the fragmentation process may also be assisted by ETD, in which analyte ions exchange charge with reagent ions. Less preferred embodiments are also contemplated wherein ETD may be the sole or dominant mechanism by which parent ions are caused to fragment or dissociate.

BRIEF DESCRIPTION OF THE DRAWINGS

Various embodiments of the present invention will now be described, by way of example only, and with reference to the accompanying drawings, in which.

DETAILED DESCRIPTION OF THE PREFERRED EMBODIMENTS

Figure 1:
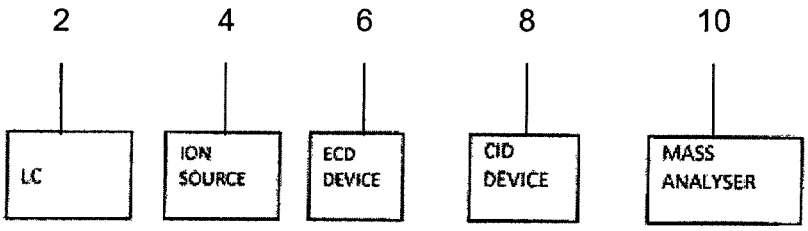
FIG. 1 shows a schematic of a preferred embodiment in which parent ions and their fragment ions are associated based on their liquid chromatography elution times.

FIG. 1 shows a schematic of a preferred embodiment in which parent ions and their fragment ions are essentially associated based on their liquid chromatography elution times. The basic components of this embodiment comprise a liquid chromatography device 2, an ion source 4, an ECD device 6, a CID device 8 and a mass analyser 10.

Different analytes elute from the liquid chromatography device 2 at different times and are then ionised by the ion source 4 so as to form parent ions. The parent ions then pass through an atmospheric pressure ECD device 6. The ECD device 6 comprises a UV lamp that is repeatedly switched ON and OFF. When the lamp is OFF, the parent ions are not subjected to ECD conditions and so the parent ions simply continue to the mass analyser 10 and are then mass analysed. In contrast, when the UV lamp is switched ON, the UV lamp emits UV photons that are absorbed by a gas, resulting in the release of photoelectrons. These photoelectrons interact with the parent ions to produce ECD fragment and product ions. The product ions may include ECnoD product ions, which are parent ions that have been reduced in charge due to the ECD conditions, but which have not dissociated. These fragment and product ions then pass to the mass analyser 10 and are mass analysed. It is to be noted that the CID device 8 is not operational in this mode. As the UV lamp is repeatedly switched ON and OFF, the parent ions are intermittently and repeatedly subjected to ECD conditions such that the ions leaving the ECD device 6 alternate between parent ions and their corresponding fragment or product ions.

It will be appreciated that the liquid chromatography device 2 and the ion source 4 serve to generate parent ions that are spatially separated as they travel towards the ECD device 6 and mass analyser 10. The UV lamp is switched ON and OFF at a rate that is sufficiently high that ions of each type of parent ion pass through the ECD device 6 during a time period in which the lamp is ON and also during a time period in which the lamp is OFF. The mass analyser 10 therefore detects a parent ion and its fragment or product ions at substantially the same time, i.e. at substantially the same liquid chromatography elution time. The parent ions and their respective fragment or product ions can therefore be associated with each other relatively easily and based on the fact they have been detected at substantially the same time.

As described above, subjecting the parent ions to ECD conditions may produce intermediate ions such as ECnoD product ions. These ions may be charge reduced parent ions that have not dissociated under the ECD conditions. It may be desirable to fragment these ECnoD product ions and detect their fragments in order to identify the ECnoD product ions and hence help to identify the analyte from which they are derived. It may therefore also be desirable to associate the ECnoD product ions with their respective fragment ions in order to do this. According to this mode of operation, the CID device 8 in FIG. 1 becomes operational.

As has been described above, the ECD device 6 subjects parent ions to ECD conditions so as to produce ECnoD product ions, which are then received at the CID device 8. During a period in which the ECD conditions are present, the CID device 8 is initially inactive (i.e. operated in a low collision mode) such that the ECnoD product ions are not dissociated by CID and are detected by the mass analyser 10. Whilst the ECD conditions are still present, the CID device 8 is then activated (i.e. operated in a high collision mode) such that the ECnoD product ions are subjected to collisionally induced dissociation and consequently fragment into fragment ions. The CID fragments of the ECnoD product ions are then detected at the mass analyser 10. As described above, the UV lamp is switched ON and OFF at a rate that is sufficiently high that parent ions of each type pass through the ECD device during a time period in which the lamp is ON and also during a time period in which the lamp is OFF. As the CID device 8 is inactive and then active within each period that the lamp is ON, the switching of the CID device 8 between its two modes occurs at a relatively high rate and so the mass analyser 10 will detect ECnoD product ions and their CID fragment ions at substantially the same time, i.e. at substantially the same liquid chromatography elution time. Corresponding parent ions will also be detected at substantially the same time, when the lamp is switched OFF. The CID fragment ions can therefore be associated with their ECnoD product ions and/or their parent ions relatively easily and based on the fact they have been detected at substantially the same time.

According to a preferred method, three scans may be performed. A first scan may be performed wherein the UV lamp is switched OFF so that no ECD fragment or product ions are generated and wherein the parent ions are not subjected to CID fragmentation. Parent ions are detected by the mass analyser 10 in this scan. A second scan may also be performed wherein the UV lamp is switched ON so that ECD fragment and ECnoD product ions are generated, but wherein the ECD fragment and product ions are not subjected to CID fragmentation. In this scan the mass analyser 10 detects the ECD fragment and product ions. A third scan may also be performed wherein the UV lamp is switched ON so that ECD fragment and ECnoD product ions are generated and wherein the resulting ECD fragment and product ions are then subjected to CID fragmentation. In this scan the mass analyser 10 detects the ECD fragment ions and CID fragment ions. The time profiles of the first and second scans may then be matched so as to match ECD fragment and product ions with their corresponding parent or precursor ions. The time profiles of the second and third scans may be used for matching ECnoD product ions with their corresponding CID fragment ions. The time profiles of the first and third scans may be used for matching the CID fragment ions to their parent ions. The three scans are preferably performed successively in a cycle and may be performed in any order in the cycle, although it is preferred that the second and third scans are performed one after the other. The cycle of the three scans is repeated continuously during the analysis of the analyte and at a rate that is sufficiently high to correlate the ions in the respective scans of each cycle.

Figure 2:
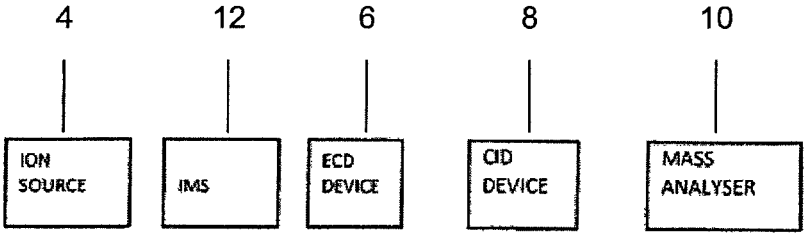
FIG. 2 shows a schematic of a preferred embodiment in which parent ions and their fragment ions are associated based on their ion mobility drift times.

FIG. 2 shows a schematic of a preferred embodiment in which parent ions and their fragment ions are essentially associated based on their ion mobility drift times. The basic components of this embodiment comprise an ion source 4, an ion mobility spectrometer 12 (IMS), an ECD device 6, a CID device 8 and a mass analyser 10.

Parent ions are generated by the ion source 4 and then pass to the IMS device 12. Different parent ions have different mobilities and hence pass through the IMS device 12 with different drift times. The different parent ions leave the IMS device 12 at different times and then pass through an atmospheric pressure ECD device 6. The ECD device 6 operates as described above with regard to FIG. 1. When the lamp is OFF, the parent ions are not subjected to ECD conditions and so the parent ions simply continue to the mass analyser 10 and are then mass analysed. In contrast, when the UV lamp is switched ON, the parent ions produce ECD fragment and product ions, including ECnoD product ions. These fragment and product ions then pass to the mass analyser 10 and are mass analysed. It is to be noted that the CID device 8 is not operational in this mode. As the UV lamp is repeatedly switched ON and OFF, the parent ions are intermittently and repeatedly subjected to ECD conditions such that the ions leaving the ECD device 6 alternate between parent ions and their corresponding fragment or product ions.

It will be appreciated that the IMS device 12 spatially separates the parent ions as they travel towards the ECD device 6 and mass analyser 10. The UV lamp is switched ON and OFF at a rate that is sufficiently high that ions of each type of parent ion pass through the ECD device during a time period in which the lamp is ON and also during a time period in which the lamp is OFF. The mass analyser 10 therefore detects a parent ion and its fragment or product ions at substantially the same time, i.e. at substantially the same IMS drift time. The parent ions and their respective fragment or product ions can therefore be associated with each other relatively easily and based on the fact that they have been detected at substantially the same time.

As described above, subjecting the parent ions to ECD conditions may also produce intermediate ions such as ECnoD product ions. It may be desirable to fragment these ECnoD product ions and detect their fragments in order to identify the ECnoD product ions and hence help to identify the analyte from which they are derived. It may therefore be desirable to associate the intermediate ions with their respective fragment ions in order to do this. According to this mode of operation, the CID device 8 in FIG. 2 becomes operational.

As has been described above, the ECD device 6 subjects parent ions to ECD conditions so as to produce ECnoD product ions, which are then received at the CID device 8. During a period in which the ECD conditions are present, the CID device 8 is initially inactive (i.e. operated in a low collision mode) such that the ECnoD product ions are not dissociated by CID and are detected by the mass analyser 10. Whilst the ECD conditions are still present, the CID device 8 is then activated (i.e. operated in a high collision mode) such that the ECnoD product ions are subjected to collisionally induced dissociation and fragment into fragment ions. The CID fragments of the ECnoD product ions are then detected at the mass analyser 10. As described above, the UV lamp is switched ON and OFF at a rate that is sufficiently high that parent ions of each type pass through the ECD device 6 during a time period in which the lamp is ON and also during a time period in which the lamp is OFF. As the CID device 8 is inactive and then active within each period that the lamp is ON, the switching of the CID device 8 between its two modes occurs at a relatively high rate and so the mass analyser 10 will detect ECnoD product ions and their CID fragment ions at substantially the same time, i.e. at substantially the same IMS drift time. Corresponding parent ions will also be detected at substantially the same time, when the lamp is switched OFF. The CID fragment ions can therefore be associated with their ECnoD product ions and/or parent ions relatively easily and based on the fact that they have been detected at substantially the same time. According to a preferred method, three scans may be performed, in a corresponding manner to that described above with respect to FIG. 1.

The preferred embodiments enable parent ions and their and fragment or product ions to be associated with each other by matching similar liquid chromatography time profiles and/or ion mobility drift time profiles. The preferred methods are particularly advantageous and may be implemented in mass spectrometers fitted with an atmospheric pressure ECD fragmentation source. The preferred method differs substantially from conventional techniques in that conventional techniques select precursor or parent ions prior to an electron capture event and also do not match elution profiles. Furthermore, the technique of generating c- and z-type ions according to the preferred methods of the present invention is significantly simplified compared with existing vacuum ECD techniques that involve more complex and expensive instrumentation modifications.

The present invention is particularly beneficial for analysing and preferably identifying biomolecules. The present invention is particularly beneficial, in the preferred methods, for fragmenting and analysing disulphide linked biomolecules.

Although the specific embodiments have been described above in terms of an ECD device comprising a UV lamp, it is contemplated herein that other types of ECD devices may be used to generate ECD conditions in ways other than by using a UV lamp. For example, the ECD device may operate using a high voltage corona discharge, a glow discharge or a low temperature plasma. Furthermore, it is also contemplated that an ETD device may be used instead of an ECD device. It is also contemplated that rather than switching between activating and deactivating the ECD or ETD device, the parent ions may be switched between passing through and bypassing an ECD or ETD device that may be operating continuously.

It is also contemplated that a method of supplemental activation other than CID may be used to fragment the intermediate product ions. It is also contemplated that methods of supplemental activation may be performed under vacuum conditions rather than at atmospheric pressure. It is also contemplated that rather than switching the supplemental activation device (e.g. CID device) between an active and inactive mode, the intermediate product ions may be switched between passing through and bypassing a supplemental activation device that may be operating continuously.

In the specific embodiments described above, liquid chromatography and IMS techniques have been described for providing spatially separated parent ions to the ECD device. However, it will be appreciated that other separation means may be used to perform this function.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

(i) providing a plurality of different parent ions;

(ii) mass analysing said parent ions so as to obtain first mass spectral data;

(iii) subjecting said parent ions to Electron Capture Dissociation ("ECD") or Electron Transfer Dissociation ("ETD") at atmospheric pressure to produce fragment or product ions;

(iv) mass analysing said fragment or product ions so as to obtain second mass spectral data;

(v) wherein the parent ions are intermittently and repeatedly subjected to said ECD or ETD such that the method repeatedly alternates between steps (ii) and (iv); and (vi) associating parent ions detected in said first mass spectral data with fragment or product ions detected in said second mass spectral data.

2. The method of claim 1, wherein parent ions in any given set of first mass spectral data are associated with fragment ions in a set of second mass spectral data that is obtained immediately before or immediately after said given set of first mass spectral data is obtained.

3. The method of claim 1, wherein the method alternates between steps (ii) and (iv) at a rate such that each species of parent ion in said plurality of different parent ions is subjected to both said steps (ii) and (iv).

4. The method of claim 1, wherein the step of providing the plurality of different parent ions comprises providing different parent ions that are spatially separated from each other such that they are received at a mass analyser at different times and so are mass analysed at different times in step (ii).

5. The method of claim 4, wherein the parent ions are subjected to said ECD or ETD after they have been separated and such that fragment or product ions that are derived from different parent ions are mass analysed in step (iv) at different times.

6. The method of claim 1, wherein the parent ions are generated by subjecting a sample to chromatography and ionising the eluting sample, and wherein parent ions detected in said first mass spectral data are associated with fragment ions detected in said second mass spectral data by matching chromatographic elution time profiles of ions observed in the first mass spectral data with chromatographic elution time profiles of ions observed in the second mass spectral data.

7. The method of claim 1, wherein different parent ions are separated in an ion mobility spectrometer according to their ion mobilities such that they are received at a mass analyser at different times and so are mass analysed at different times in step (ii), and wherein the ions detected in the first mass spectral data are associated with fragment ions detected in the second mass spectral data by matching ion mobility drift time profiles of ions observed in the first mass spectral data with ion mobility drift time profiles of ions observed in the second mass spectral data.

8. The method of claim 1, wherein the step of intermittently and repeatedly subjected the parent ions to said ECD or ETD comprises either:

repeatedly and intermittently providing electrons or reagent anions to a dissociation region through which the parent ions pass for inducing said ECD or ETD; or performing said ECD or ETD in a dissociation region and repeatedly and intermittently causing parent ions to bypass the dissociation region.

9. The method of claim 8, comprising using a photo-ionisation source to generate said electrons or reagent ions and repeatedly switching the photo-ionisation source ON and OFF; or repeatedly causing said parent ions to by-pass the photo-ionisation source.

10. The method of claim 1, further comprising subjecting said fragment or product ions to a fragmentation technique other than atmospheric pressure ECD or ETD between steps (iii) and (iv) and mass analysing the resulting ions in step (iv).

11. The method of claim 1, wherein said method comprises performing a cycle comprising:

(i) mass analysing said parent ions so as to obtain said first mass spectral data;

(ii) subjecting said parent ions to ECD or ETD at atmospheric pressure to produce fragment or product ions; and mass analysing said fragment or product ions to obtain said second mass spectral data; and (iii) subjecting said parent ions to ECD or ETD at atmospheric pressure, thereby producing intermediate ions, wherein the intermediate ions are non-dissociated parent ions held together by non-covalent interactions or are charge-reduced parent ions that have not fragmented after being exposed to the ECD or ETD conditions; and subjecting said intermediate ions to a fragmentation technique other than atmospheric pressure ECD or ETD such that said intermediate ions fragment to form fragment ions; and mass analysing these fragment ions so as to obtain third mass spectral data.

12. The method of claim 11, wherein in step (ii) of claim 11 parent ions are substantially only fragmented by ECD or ETD reactions.

13. The method of claim 11, wherein the method repeatedly performs said cycle.

14. The method of claim 11, further comprising associating the fragment ions produced by step (iii) with parent ions that are mass analysed in the same cycle.

15. The method of claim 11, wherein the method alternates between steps (i), (ii) and (iii) at a rate such that each species of parent ion in said plurality of ions is subjected to all three steps.

16. The method of claim 10, wherein said fragmentation technique other than atmospheric pressure ECD or ETD is Collisionally Induced Dissociation ("CID").

17. The method of claim 10, wherein said fragmentation technique other than atmospheric pressure ECD or ETD is the fragmentation of ions by ECD or ETD under vacuum conditions.

18. A mass spectrometer comprising:

an atmospheric pressure Electron Capture Dissociation ("ECD") or Electron Transfer Dissociation ("ETD") device;

a mass analyser; and a control system arranged and adapted to:

mass analyse parent ions so as to obtain first mass spectral data, in a first mode of operation;

subject said parent ions to ECD or ETD at atmospheric pressure to produce fragment or product ions;

mass analyse said fragment or product ions so as to obtain second mass spectral data, in a second mode of operation;

intermittently and repeatedly subject said parent ions to said ECD or ETD so as to alternate between the first and second modes of operation; and associate parent ions detected in said first mass spectral data with fragment or product ions detected in said second mass spectral data.

19. A method of mass spectrometry comprising:

providing a plurality of different parent ions; and performing at least one cycle comprising:

(i) mass analysing said parent ions so as to obtain first mass spectral data;

(ii) subjecting said parent ions to Electron Capture Dissociation ("ECD") or Electron Transfer Dissociation ("ETD") to produce fragment or product ions; and mass analysing said fragment or product ions so as to obtain second mass spectral data;

(iii) subjecting said parent ions to ECD or ETD, thereby producing intermediate ions, wherein the intermediate ions are non-dissociated parent ions held together by non-covalent interactions or are charge-reduced parent ions that have not fragmented after being exposed to the ECD or ETD conditions; and subjecting said intermediate ions to a fragmentation technique other than ETD or ECD such that said intermediate ions fragment to form fragment ions; and mass analysing these fragment ions so as to obtain third mass spectral data; and (v) associating parent ions detected in said first mass spectral data with fragment or product ions detected in said second or third mass spectral data.

20. A mass spectrometer comprising:

an Electron Capture Dissociation ("ECD") or Electron Transfer Dissociation ("ETD") device;

a mass analyser; and a control system arranged and adapted to perform at least one cycle comprising:

(i) mass analysing parent ions so as to obtain first mass spectral data;

(ii) subjecting parent ions to ECD or ETD to produce fragment or product ions; and mass analysing said fragment and/or product ions so as to obtain second mass spectral data;

(iii) subjecting parent ions to ECD or ETD, thereby producing intermediate ions, wherein the intermediate ions are non-dissociated parent ions held together by non-covalent interactions or are charge-reduced parent ions that have not fragmented after being exposed to the ECD or ETD conditions; and subjecting said intermediate ions to a fragmentation technique other than ETD or ECD such that said intermediate ions fragment to form fragment ions; and mass analysing these fragment ions so as to obtain third mass spectral data; and (v) associating parent ions detected in said first mass spectral data with fragment or product ions detected in said second or third mass spectral data.

21. A method of mass spectrometry comprising:

generating a plurality of species of parent ions;

varying the intensity profile of one or more species of parent ions as a function of time so that different species of parent ions are caused to have different intensity profiles as a function of time;

subjecting said parent ions to Electron Capture Dissociation ("ECD") or Electron Transfer Dissociation ("ETD") at atmospheric pressure to produce fragment or product ions;

mass analysing the fragment ions; and correlating the fragment ions with corresponding parent ions on the basis of the intensity profiles of said fragment ions and the intensity profiles of said parent ions.

22. The method of claim 21, comprising mass analysing the parent ions in order to obtain said profile of one or more species of parent ions.

23. The method of claim 22, wherein the method repeatedly alternates between mass analysing parent ions, and fragmenting parent ions and mass analysing the fragment ions.

24. The method of claim 21, wherein said step of varying the intensity profile of one or more species of parent ions as a function of time comprises subjecting an analyte sample to chromatography; and wherein parent ions are correlated with fragment ions by matching chromatographic elution time profiles of the parent and fragment ions.

25. The method of claim 21, wherein said step of varying the intensity profile of one or more species of parent ions as a function of time comprises separating the parent ions in an ion mobility spectrometer, and wherein the parent ions are correlated with fragment ions by matching ion mobility drift time profiles of the parent and fragment ions.

26. A mass spectrometer comprising:

means for generating a plurality of species of parent ions;

means for varying the intensity profile of one or more species of parent ions as a function of time so that different species of parent ions are caused to have different intensity profiles as a function of time;

means for subjecting said parent ions to Electron Capture Dissociation ("ECD") or Electron Transfer Dissociation ("ETD") at atmospheric pressure to produce fragment or product ions;

means for mass analysing the fragment ions; and means for correlating the fragment ions with corresponding parent ions based on of the intensity profiles of said fragment ions and the intensity profiles of said parent ions.

* * * * *